US005513961A

United States Patent [19]

Engdahl et al.

[11] Patent Number: 5,513,961

[45] Date of Patent: May 7, 1996

[54] METHOD AND APPARATUS FOR IMPROVING PUMP NET POSITIVE SUCTION HEAD

[75] Inventors: Gerald E. Engdahl, Wheaton; William S. Schoerner, Plainfield; Joseph P. Mavec, Joliet, all of Ill.

[73] Assignee: Chicago Bridge & Iron Technical Services Company, Oak Brook, Ill.

[21] Appl. No.: 287,786

[22] Filed: Aug. 9, 1994

[51] Int. Cl.[6] ..... F04B 39/14; F17C 7/02

[52] U.S. Cl. ..... 417/313; 417/53; 62/50.1; 62/50.6

[58] Field of Search ..... 62/50.1, 50.5, 62/50.6, 50.2; 417/313, 307, 53

[56] References Cited

U.S. PATENT DOCUMENTS

| | | | |
|---|---|---|---|
| 4,731,999 | 3/1988 | Niemiec | 417/307 |
| 4,796,434 | 1/1989 | Garnreiter | 62/50.5 |
| 4,932,214 | 6/1990 | Nieratscher et al. | 62/50.6 |

FOREIGN PATENT DOCUMENTS

| | | | |
|---|---|---|---|
| 3518283 | 11/1986 | Germany | 62/55.5 |

OTHER PUBLICATIONS

Beale, "LNG as a Transportation Fuel TOPTEC." *Paper Presented at SAE* (Jan. 1993).

Biederman et al., "Evaluation and Economic Analysis of LNG for Heavy–Duty Transportation Applications." *The LNG Observer* (1990/1991).

"NVE's New LGN Station Design." *LNG Express* (Jan./Feb. 1993).

"Houston Metro's Fueling Stations Go On–line." *LNG Express Project Survey* (May/Jun. 1993).

*Primary Examiner*—Charles Freay

*Attorney, Agent, or Firm*—Marshall, O'Toole, Gerstein, Murray & Borun

[57] ABSTRACT

A method and apparatus are disclosed for improving the available pump net positive suction head in a system for pumping liquid from a storage tank. When the liquid in the system is at or near its boiling point, a pump suction vessel is used to store and cool the liquid. The liquid in the pump suction vessel is kept at a temperature lower than its boiling point by surrounding the vessel with a jacketed space containing liquid from the storage tank. As the liquid in the jacketed space evaporates, the vapor is vented to the storage tank and more liquid is fed into the jacketed space.

14 Claims, 1 Drawing Sheet

METHOD AND APPARATUS FOR IMPROVING PUMP NET POSITIVE SUCTION HEAD

The present invention relates generally to pumps for liquids and more particularly to a method and apparatus for improving pump available net positive suction head in a system for pumping liquid that is near its boiling point.

BACKGROUND OF THE INVENTION

A pump operates by drawing fluid at a low pressure from a suction line into a pump inlet and propelling fluid out of a pump outlet at a higher pressure or velocity. For proper operation each pump requires a net positive suction head (NPSH-R) which is the equivalent total head of liquid at the pump centerline less the vapor pressure of the liquid at the pump centerline. The pump manufacturer establishes the NPSH-R required for each pump. In an installation, the available net positive suction head (NPSH-A) must be equal to or greater than the NPSH-R of the pump. If the NPSH-A is not adequate, the pump may cavitate. Cavitation at start up may prevent the pump from pumping and may cause damage to the pump parts. Fluids near their boiling point have lower NSPH-A, making them difficult to pump. When the fluid in the suction line is colder than the ambient temperature, the heat leak into the suction line will warm the fluid and further reduce the NPSH.

Various methods are used to increase the NPSH-A in a pumping system where the fluid is at or near its boiling point. Insulating the suction line decreases the rate of heat leak to the fluid, but if the pump is not operating, the heat leak will eventually cause the fluid to boil and the NPSH available to the pump at start up will be near zero. Unless the pump NPSH-R requirement is zero, the pump at start up will cavitate and cause a pumping failure, regardless of the head in a reservoir from which the fluid is pumped. Thus, after inactive periods, the initial pump start-up may be difficult or impossible.

SUMMARY OF THE INVENTION

The present invention provides a method and apparatus for improving the NPSH-A to a pump, particularly at initial start-up.

Apparatus for improving available NPSH in accordance with the present invention includes a storage tank for supplying liquid, a pump suction vessel for receiving and storing liquid from the storage tank; a jacketed space at least partially surrounding the pump suction vessel and for receiving and storing liquid from the storage tank, a liquid level controller for the jacketed space, and a pump having an inlet, the inlet having means for receiving liquid from the pump suction vessel.

The apparatus may include a hose for receiving liquid from a pump outlet, a liquid-vapor separator for receiving liquid from the storage tank and separating vapor from the liquid and feeding liquid to the pump suction vessel, conduits for returning vapor to the storage tank from the liquid-vapor separator, the jacketed space, or the pump. The liquid-vapor separator may be a float valve having means for venting vapor from the pump suction vessel. Further, there may be a drain for the jacketed space to drain liquid from the space.

One way to maintain the level of liquid in the jacketed space is to provide a level sensor such as a differential pressure gauge that opens a valve to admit liquid from the storage tank into the jacketed space until the desired level is reached.

A method in accordance with the present invention includes storing liquid in a storage tank, draining liquid from the storage tank into a pump suction vessel, surrounding at least part of the pump suction vessel with liquid from the storage tank to maintain the temperature of the liquid in the pump suction vessel at or lower than its boiling point, and pumping liquid from the pump suction vessel.

The method may include separating vapor from the liquid before it enters the pump suction vessel.

The step of surrounding at least part of the pump suction vessel with liquid from the storage tank may include draining liquid from the storage tank into a jacketed space that surrounds the pump suction vessel. The liquid in the jacketed space will be at its boiling point and colder than the liquid in the pump suction vessel. Heat transfer from the pump suction vessel liquid to the jacketed space provides the pump suction vessel cooling. Vapor may be recovered from the jacketed space, the pump, the liquid-vapor separator and returned to the storage tank.

DETAILED DESCRIPTION OF THE DRAWING

Figure 1:
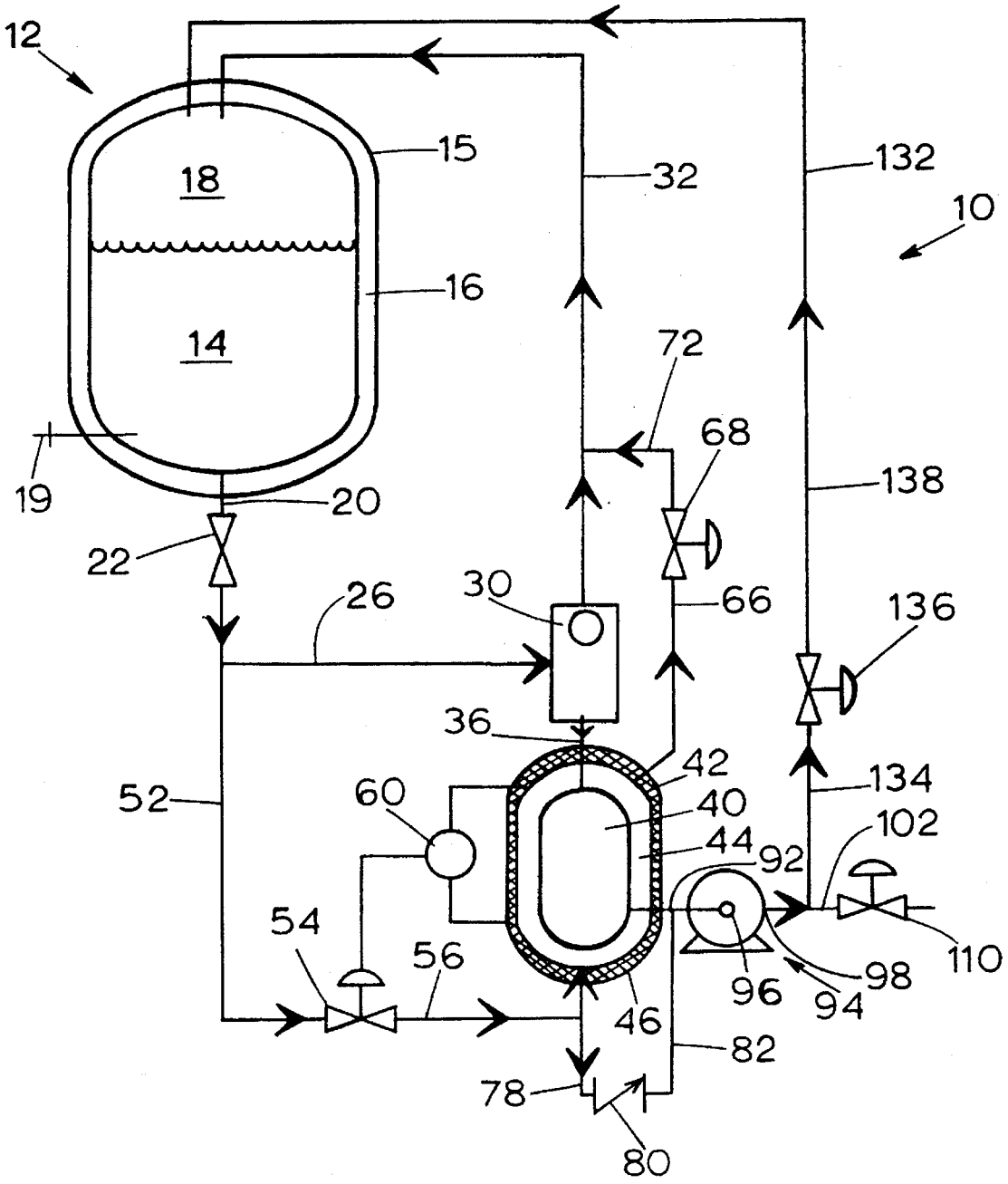
FIG. 1 diagrammatically illustrates an apparatus useful in practicing the invention.

FIG. 1 illustrates apparatus 10 for improving available pump net positive suction head (NPSH) where the liquid being pumped is at or near its boiling point. A storage tank 12 is constructed of a suitable material for safely storing a liquid 14 such as liquefied natural gas, propane, liquid nitrogen, and liquid carbon dioxide. The illustrated apparatus 10 is suitable for use as part of a liquefied natural gas (LNG) fueling station in which the tank 12 stores LNG at about 15 psig to 45 psig and corresponding saturation temperature of about −242° F. to −222° F.

The tank 12 is preferably insulated in some suitable manner to reduce the rate of heat leak into the tank 12. Here the insulating feature is illustrated as a vacuum jacket 15 that defines a vacuum space 16. A vapor space 18 is inside the upper part of tank 12. Fill conduit 19 communicates with the interior of the tank 10 to provide a means for filling the tank with liquid 14.

Tank drain conduit 20 communicates with the lower interior space of the tank 12 to provide a means for draining the tank 12 and includes tank drain valve 22.

A conduit 26 downstream of the tank drain valve 22 transfers liquid 14 from the tank drain valve 22 to a liquid-vapor separator 30. The liquid-vapor separator 30 is optionally, but not necessarily, provided to draw off any vapor that may accumulate as a result of heat leak into conduits 20 and 26. The vapor is returned to the vapor space 18 in the tank 12 via vapor return conduit 32. The liquid-vapor separator 30 can be any suitable mechanism and is preferably a float valve.

A conduit 36 communicates with the liquid-vapor separator 30 to deliver liquid 14 downstream to a pump suction vessel 40 that is constructed of any suitable material for storing liquid 14 in much the same manner as the tank 12. The pump suction vessel 40 is at least partially surrounded by a jacket 42 to define a jacketed space 44. The pump suction vessel 40 illustrated in FIG. 1 is completely surrounded by the jacket 42 and jacketed space 44, less of course, any openings necessary to make conduit or sensor connections. Outside of the jacketed space 44 there is insulation 46 to reduce the rate of heat leak to the vessel 40.

Once liquid 14 is received into the pump suction vessel 40 it is maintained at a temperature less than its boiling point by filling the jacketed space 44 with liquid 14 from the tank 12 via conduit 52 which communicates with conduit 26 to deliver liquid to a control valve 54 that controls the amount of liquid 14 that is supplied to the jacketed space 44.

The control valve 54 is activated by a level sensor 60 so that liquid 14 within the jacketed space 44 is maintained at a predetermined level. Level sensor 60 may be any suitable mechanism including, but not limited to, a differential pressure gauge, capacitance probes, sonic probes, optical sensors, or float switches, and includes means for generating a signal to open or close the control valve 54 as needed.

Vapor generated in jacketed space 44, vapor is vented through conduit 66 and vapor vent control valve 68. Vapor passes through the vapor vent valve 68 to conduit 72 which communicates with vapor return conduit 32 to return vapor to the vapor space 18 in the tank 12.

From time to time it may become necessary to drain liquid 14 from the jacketed space 44. This draining may be necessary when, for example, liquid 14 is liquefied natural gas, which includes methane, propane, ethane and other constituents. As liquid 14 absorbs heat, the "lightest" constituent, methane, will boil first, leaving the "heavier" constituents behind. Consequently, the boiling point of the remaining "heavier" liquid will be warmer than liquid 14.

Thus, when pump 94 is not operating, the liquid in the jacketed space 44 will need to be drained through conduit 78 which communicates with a lower part of the jacketed space 44. Valve 68 is closed causing the pressure in the jacketed space 44 to increase. Liquid 14 is drained through conduit 78 and flows through a check valve 80 into conduit 92. After the liquid has been drained from space 44, valves 68 and 54 are opened and fresh liquid is added to space 44.

A suction conduit 92 communicates with the lower right side of the pump suction vessel 40 to transfer liquid 14 downstream to the pump 94 which has an intake 96 and an outlet 98. As the pump 94 is activated, liquid is drawn from the pump suction vessel 40, through the suction conduit 92, and out of the outlet 98 where it flows under pressure into conduit 102.

If the pump 94 is required to be in a continual operating stand-by mode such that it must constantly pump liquid 14, a by-pass conduit 134 is provided which communicates with conduit 102 upstream from valve 110. Valve 110 is shut-off while in stand-by mode to direct liquid 14 into conduit 134, through a by-pass valve 136 or other suitable flow restriction device which is open in stand-by mode, and through conduit 138 so that pumped liquid 14 can be recycled back to the tank 12.

In operation, the apparatus 10 can be used in LNG fueling service. The tank 12 is filled with liquefied natural gas 14 or other appropriate liquid through fill conduit 19 using any conventional means. Opening the drain valve 22 allows liquefied natural gas 14 to flow through tank drain conduit 20, conduit 26, and into the liquid-vapor separator 30. The liquid-vapor separator 30 vents vapor that is generated by heat gain into conduits 20 and 26 to the vapor space 18 of the tank 12 and passes liquid 14 to flow through conduit 36 and into the pump suction vessel 40.

To cool liquid in the pump suction vessel 40, the control valve 54 is opened by the level sensor 60 and the jacketed space 44 is filled with liquid 14 from the tank 12. Liquid 14 slowly boils and vaporizes, the resulting vapor is vented through conduit 66, vapor vent control valve 68, conduit 72, and vapor return conduit 32, to be returned to the tank vapor space 18. In this way liquid 14 in the pump suction vessel 40 is cooled and maintained below its boiling point and the available net positive suction head is increased.

As stated above, this higher net positive suction head prevents cavitation of the pump 94 particularly at start-up. With the apparatus just described, the pump suction vessel 40 and the pump 94 can be located remotely from the tank 12 so long as the pump 94 is near the pump suction vessel 40.

If the liquid 14 in the tank 12 is liquefied natural gas then the liquid 14 in the jacketed space 44 will require draining periodically because methane will boil off and leave behind a heavier mixture that will have a warmer boiling point. As the temperature in the pump suction vessel 40 rises the NPSH available to the pump 94 is reduced. To avoid that, the jacketed space 44 is drained by closing valve 68 to allow the "heavy" liquid to drain through conduits 78 and 82 for delivery into suction line 92.

When liquid in the pump suction vessel 40 is cooled down, the pump 94 is activated to pump liquid. As stated above, the pump 94 may need to be on stand-by and circulate liquid 14 at all times. Under these circumstances, the valve 110 is closed and by-pass valve 136 is opened so that pumped liquid will simply recirculate through the apparatus 10. The valve 110 and the by-pass valve 136 may be opened and closed either manually or automatically using any suitable mechanism.

The foregoing detailed description has been given for clearness of understanding only, and no unnecessary limitations should be understood therefrom, as modifications will be apparent to those skilled in the art.

We claim:

1. Apparatus for improving available pump net positive suction head, the apparatus comprising:

(a) a storage tank having means for receiving a liquid;

(b) a pump suction vessel having means for receiving and storing liquid from the storage tank;

(c) a jacketed space at least partially surrounding the pump suction vessel, the jacketed space having means for receiving and storing liquid from the storage tank;

(d) means for controlling the level of liquid in the jacketed space; and (e) a pump having means for receiving liquid from the pump suction vessel.

2. The apparatus for improving available pump net positive suction head of claim 1, and further comprising:

(a) means for returning vapor from the jacketed space of the pump suction vessel to the storage tank.

3. The apparatus for improving available pump net positive suction head of claim 1, and further comprising:

(a) a liquid-vapor separator having means for receiving liquid from the storage tank, means for separating vapor from the liquid, means for returning vapor to the storage tank, and means for feeding liquid to the pump suction vessel.

4. The apparatus for improving available pump net positive suction head of claim 3, in which the liquid-vapor separator is a float valve.

5. The apparatus for improving available pump net positive suction head of claim 1, and further comprising:

(a) a drain having means for draining liquid from the jacketed space of the pump suction vessel.

6. The apparatus for improving available pump net positive suction head of claim 1, in which the storage tank is vacuum-jacketed.

7. The apparatus for improving available pump net positive suction head of claim 1, in which the jacketed space of the pump suction vessel is insulated.

8. The apparatus for improving available pump net positive suction head of claim 1, in which the jacketed space completely surrounds the pump suction vessel.

9. The apparatus for improving available pump net positive suction head of claim 1, in which the means for controlling the level of liquid in the jacketed space comprises:

(a) a control valve having means for controlling the flow of liquid from the storage tank to the jacketed space; and (b) a level sensor having means for sensing the level of liquid in the jacketed space and means for opening the control valve in response to sensing a low level of liquid to allow liquid to flow into the jacketed space.

10. The apparatus for improving available pump net positive suction head of claim 1, and further comprising:

(a) means for receiving liquid from the pump and recycling it to the storage tank.

11. A method for improving available pump net positive suction head, said method comprising the steps of:

(a) storing liquid in a storage tank;

(b) draining liquid from the storage tank to a pump suction vessel;

(c) surrounding at least a portion of the pump suction vessel with liquid from the storage tank to maintain the temperature of liquid in the pump suction vessel below its boiling point; and (d) pumping liquid from the pump suction vessel.

12. The method for improving available pump net positive suction head of claim 11, and further comprising the steps of:

(a) separating vapor from the liquid being drained from the storage tank to the pump suction vessel; and (b) returning the vapor to the storage tank.

13. The method for improving available pump net positive suction head of claim 11, in which the step of surrounding at least a portion of the pump suction vessel with liquid from the storage tank comprises the steps of:

(a) draining liquid from the storage tank to a jacketed space that at least partially surrounds the pump suction vessel;

(b) maintaining the level of liquid in the jacketed space; and (c) venting vapor from the jacketed space.

14. The method for improving available pump net positive suction head of claim 11, in which the step of surrounding at least a portion of the pump suction vessel with liquid from the storage tank comprises the steps of:

(a) draining liquid from the storage tank to a jacketed space that at least partially surrounds the pump suction vessel;

(b) maintaining the level of liquid in the jacketed vessel; and (c) periodically draining the jacketed vessel of liquid and refilling the jacketed space with fresh liquid from the storage tank.

* * * * *